US006595012B2

(12) United States Patent
Rafalovich

(10) Patent No.: US 6,595,012 B2
(45) Date of Patent: Jul. 22, 2003

(54) CLIMATE CONTROL SYSTEM

(76) Inventor: Alexander P Rafalovich, 8309 Lacevine Rd., Louisville, KY (US) 40220

( * ) Notice: Subject to any disclaimer, the term of this patent is extended or adjusted under 35 U.S.C. 154(b) by 5 days.

(21) Appl. No.: 09/968,645

(22) Filed: Sep. 29, 2001

(65) Prior Publication Data

US 2003/0061822 A1 Apr. 3, 2003

(51) Int. Cl.[7] ..... F25D 17/08
(52) U.S. Cl. ..... 62/92; 62/324.6; 62/173
(58) Field of Search ..... 62/151, 173, 176.1, 62/176.3, 176.5, 226, 90, 92, 324.1

(56) References Cited

U.S. PATENT DOCUMENTS

| | | | | | |
|---|---|---|---|---|---|
| 5,509,272 | A | * | 4/1996 | Hyde | 62/176.5 |
| 5,622,057 | A | * | 4/1997 | Bussjager et al. | 62/173 |
| 5,689,962 | A | * | 11/1997 | Rafalovich | 62/90 |
| 5,799,728 | A | * | 9/1998 | Blume | 165/231 |
| 6,212,892 | B1 | * | 4/2001 | Rafalovich | 62/90 |
| 6,293,116 | B1 | * | 9/2001 | Forrest et al. | 62/227 |

FOREIGN PATENT DOCUMENTS

| | | | | |
|---|---|---|---|---|
| JP | 54-6160 | * | 1/1979 | 62/324.1 |

* cited by examiner

*Primary Examiner*—Melvin Jones

(57) ABSTRACT

Described is a climate control system with an air conditioning or a heat pump and a method to provide desirable temperature and humidity of indoor air. In addition to a compressor, a condenser, an evaporator, and an expansion device, the air conditioner/heat pump includes an auxiliary coil, valve means, refrigerant communication means, and control means. In hot climate the system operates in two separate modes: a conventional cooling mode and a cooling mode with enhanced dehumidification. In the conventional cooling mode the valve means direct refrigerant leaving the condenser to the expansion device and then to the auxiliary coil to absorb heat from conditioning air by refrigerant in the auxiliary coil. In this mode an extra amount of liquid refrigerant is stored in the refrigerant communication means. In the mode with enhanced dehumidification the valve means direct refrigerant leaving the condenser to the auxiliary coil to reject heat to cooled and dehumidified in the evaporator air from refrigerant in the auxiliary coil. Refrigerant in the dehumidification mode is subcooled, evaporating temperature is lower and cooling capacity of the evaporator is higher than is the conventional cooling mode. These factors increase moisture condensation on the evaporator surface. On the other hand, the temperature of conditioning air is higher than in the conventional cycle due to the heat absorbed by air from the auxiliary coil. Control means that include a thermostat and a humidistat alternate a position of the valve means to provide requested temperature and humidity of indoor air. In cold climate the system may have heating means and a humidification device. Same as in the cooling operation the thermostat and the humidistat manage operations of the heating means and the humidification device.

19 Claims, 5 Drawing Sheets

CLIMATE CONTROL SYSTEM

RELATED PATENTS

This application is related to U.S. Pat. No. 6,212,892 issued on Apr. 10, 2001, entitled Air Conditioner and Heat Pump with Dehumidification, and assigned to the assignee of the present application.

FIELD OF THE INVENTION

The present invention relates generally to air conditioners and heat pumps and methods to control humidity of conditioning air.

BACKGROUND OF THE INVENTION

To warm and humidify indoor air in cold environment heat pumps, electrical or gas heaters in combination with devices injecting sprayed water in air are widely used. Also for humidification of indoor air in residential and commercial buildings different types of portable humidifiers can be used.

In hot climate air conditioners are used to cool and dehumidify air. In air conditioners air flowing through an evaporator rejects heat to the evaporating coil and simultaneously condenses moisture on the heat transfer surface of the same coil. However, in high ambient humidity, dehumidification by air conditioners is often not sufficient.

For residential and small commercial systems the most popular way of dehumidification requires installation of a dehumidifier in addition to an air conditioner. In the US the sale of portable dehumidifiers exceeds 1,000,000 each year. The dehumidifier gives consumers an advantage to control independently both parameters of indoor air: temperature and relative humidity. A thermostat controls the operation of the air conditioner depending on the room temperature and a humidistat controls the operation of the dehumidifier depending on the humidity in the room. However, this technology consumes an excessive amount of energy. First, the dehumidifier itself consumes energy to run both a compressor and a fan. Second, unlike an air conditioner where the condenser rejects heat to the ambient, in a dehumidifier the combined energy of both the compressor and the fan goes back to the room. To offset an influx of this energy the air conditioner should have extra capacity and spend extra energy.

Several attempts have been made to achieve sufficient dehumidification of conditioned air without an extra dehumidifier. Some designers use oversized air conditioners to reduce the evaporating temperature and increase moisture condensation. However, relative humidity of air leaving an oversized air conditioner may reach from 95% to 100% with the temperature below the comfortable level.

The best alternative is to use a properly sized air conditioner to cool and dehumidify indoor air. Moisture condensation depends mainly on the temperature of the evaporator heat transfer surface. Reduction in the size of the evaporating surface can reduce the evaporating temperature and increase moisture condensation. It is widely recognized, however, that smaller evaporating coil and lower evaporating temperature of refrigerant result in lower efficiency and capacity of the air conditioner. Thus, small evaporators reduce efficiency and capacity, while enlarging of the evaporators can lead to excessive relative humidity that, in turn, causes damp and mould in the room.

Some designers use a method that involves heat pipe technology. See, for example, U.S. Pat. Nos. 5,333,470 and 5,448,897. Such design adds two additional heat exchangers to the evaporator: one is a "precooling" coil upstream of the evaporator, another is a "reheating" coil downstream of the evaporator. Two coils are filled with phase change medium and connected to each other the way that the coil upstream of the evaporator picks heat from the incoming air and pumps this heat to the coil downstream of the evaporator and to outgoing air. Thus, the temperature of incoming air and the temperature of the heat transfer surfaces of the evaporator are decreased, which causes additional condensation and reduction in absolute humidity of air. Because the heat from incoming air increases the temperature of air exiting the coil downstream of the evaporator, relative humidity of air that exits the conditioner is reduced considerably. However, installation and operation of heat pipes generally involve notable expenses. In addition, such systems lead to an excessive pressure drop in air stream because there are two extra heat exchangers. In case there is no need for relative humidity reduction there is some extra complication involved in disabling of the heat pipe.

U.S. Pat. No. 3,469,353 discloses an air conditioner capable to work in the conventional and the dehumidification modes. To provide the air conditioner with dehumidification abilities the system has two outside coils, two inside coils and two capillary tubes (expansion devices). In the cooling mode refrigerant condenses in both outside coils, expands in the first capillary tube and evaporates in both inside coils. In the dehumidification mode refrigerant partly condenses in the first outside coil, then flows to the second inside coil and fully condenses there. Then liquid refrigerant expands in the second capillary tube and evaporates in the first inside coil. The cold air leaving the first inside coil goes to the second inside coil that works now as a condenser and warms up there reducing the relative humidity. Second outside coil that works as a condenser in the cooling mode in the dehumidification mode is idle. The main problem of this design is low energy efficiency. The use of the second inside coil as a condenser does not increase the cooling capacity and brings extra heat to conditioning air.

There is also a solution involving the subcooling technology. See, for example, U.S. Pat. No. 6,212,892. In the design of U.S. Pat. No. 6,212,892 an auxiliary coil is installed in an air passage downstream of the evaporator. In the dehumidification mode hot liquid refrigerant leaving the condenser expands in a pressure reduction device, then flows to an auxiliary coil that works as a subcooler rejecting heat from refrigerant to air cooled in the evaporator. After being in the auxiliary coil refrigerant goes to an expansion device and then to the evaporator. In the evaporator liquid refrigerant evaporates absorbing heat from air. Since refrigerant is preliminary subcooled, capacity of the evaporator increases and the temperature of its heat transfer surface goes down. Much like with the heat pipe technology, it causes additional condensation and reduction in absolute humidity of air. Because the temperature of air exiting the subcooling coils after the evaporator is increased, relative humidity of air is further reduced. This design is relatively simple and can provide equal or even better dehumidification as provided in air conditioners with heat pipes. When desirable humidity level is achieved, air conditioner works in a conventional cooling mode. A valve directs refrigerant flow that was liquefied in the condenser to an expansion device and after it expands there it directs it to the auxiliary coil that now works as a part of the evaporator. The temperature of air leaving the air conditioner in the conventional mode is lower and relative humidity is higher. Alternation of conventional and dehumidification modes can provide desirable level of humidity and temperature in the room. However, the system requires more refrigerant in the dehumidification mode than in the conventional cooling mode. Reduced refrigerant charge may reduce capacity and moisture condensation in the dehumidification mode, while excessive amount of refrigerant can cause an increase in the condensing temperature and efficiency in the conventional mode. To overcome this, a receiver may be installed. Still, the efficiency of the air conditioner in the conventional cycle, especially with a capillary tube or a short tube restrictor, can be lower than in the traditional design.

SUMMARY OF THE INVENTION

One preferred embodiment of the invention provides a climate control system with an air conditioner or a heat pump for conditioning air. The system includes a compressor for compressing gaseous refrigerant, a condenser for condensing refrigerant exiting the compressor, an expansion device to expand liquid refrigerant in both directions, an evaporator for evaporating liquid refrigerant after the expansion device, an auxiliary coil for either subcooling or evaporating liquid refrigerant, valve means to direct refrigerant flow leaving the condenser either to the expansion device to absorb heat from conditioning air by refrigerant in the auxiliary coil or to the auxiliary coil to reject heat to the air from refrigerant in the auxiliary coil, a refrigerant line connecting the auxiliary coil and the expansion device, a refrigerant line connecting the auxiliary coil and the valve means, refrigerant communication means to connect the valve means and the expansion device and to store extra amount of liquid refrigerant at the time when the auxiliary coil absorbs heat from conditioning air; a fan for moving air to be conditioned against the evaporator and against the auxiliary coil, and control means to control the operation of the compressor and the fan and the position of the valve means.

Further in accordance with the present invention, a four-way reversing valve as the valve means is provided.

In accordance with another aspect of the invention, the system further comprises a restrictor positioned in the refrigerant line that connects the valve means and the auxiliary coil. The restrictor expands refrigerant in one direction and allows a free pass in the other direction.

In accordance with yet another aspect of the invention, the refrigerant communication means further consist of tubing and an auxiliary volume to accommodate an extra amount of liquid refrigerant.

In accordance with yet another aspect of the invention the system further comprises heating means to operate in a heating mode and a humidification device to humidify indoor air.

In the several embodiments of the invention, the control means include a thermostat, a humidistat, and an evaporator surface temperature sensor to control the valve means and the system operation. Depending on the thermostat and the humidistat settings and on the condition of air the system is either in operation or off. While the system is in the cooling or the dehumidification operations, the valve means direct refrigerant flow to either absorb heat by refrigerant from conditioning air in the auxiliary coil or to reject heat to the air from refrigerant in the auxiliary coil. The evaporator temperature sensor shows when the temperature of the evaporator surface drops below some predetermined level. To prevent building of ice on the surface control means either redirect the refrigerant flow with the valve means or turn off the compressor. In the heating mode the control means control operations of the heating means and the humidification device.

Another preferred embodiment of the invention provides a climate control system with an air conditioner or a heat pump for conditioning air. The system comprises a compressor for compressing gaseous refrigerant, a condenser for condensing refrigerant after exiting the compressor, an expansion device to expand liquid refrigerant in both directions, an evaporator for evaporating liquid refrigerant after the expansion device, an auxiliary coil either for subcooling or for evaporating liquid refrigerant, valve means to direct refrigerant to the auxiliary coil—either to absorb heat from conditioning air by refrigerant in the auxiliary coil or to reject heat to conditioning air from refrigerant in the auxiliary coil, a receiver to accommodate a part of liquid refrigerant at the time when the auxiliary coil absorbs heat from conditioning air; a fan for moving air to be conditioned against the evaporator and against the auxiliary coil, control means to control the operation of the compressor and the fan and to control the position of the valve means.

In accordance with yet another aspect of the invention, the valve means is a four-way valve.

In another embodiment of the present invention, a method for cooling and dehumidification of air using an air conditioning and heat pump system is provided. The system includes a refrigerant circuit and an air circuit. The refrigerant circuit consists of a compressor, a condenser, an expansion device, refrigerant communication means between the condenser and the expansion device, an auxiliary coil, an evaporating coil, and valve means to direct refrigerant flow after the condenser either to the auxiliary coil or to the expansion device and to direct refrigerant flow after the auxiliary coil either to the expansion device or to the evaporating coil. The air circuit includes a fan moving air to be conditioned.

Operation in the cooling mode comprises of the steps of compressing gaseous refrigerant in the compressor, condensing refrigerant in the condenser, flowing liquid refrigerant through the refrigerant communication means to the expansion device, expanding refrigerant in the expansion device, flowing refrigerant to the auxiliary coil, partially evaporating refrigerant in the auxiliary coil to cool the coil and passing air, flowing partially liquid, partially vapor refrigerant to the evaporating coil, completely evaporating refrigerant in the evaporating coil to cool the evaporating coil and passing air, flowing vaporized refrigerant to the compressor; moving a stream of warm air against the evaporating coil and against the auxiliary coil to cool the air.

Operation in the dehumidification mode comprises of the steps of compressing gaseous refrigerant in the compressor, condensing refrigerant in the condenser, flowing liquid refrigerant to the cooled auxiliary coil, subcooling refrigerant in the auxiliary coil and warming passing air, flowing subcooled liquid refrigerant after the auxiliary coil to the expansion device, expanding refrigerant in the expansion device, flowing refrigerant to the evaporating coil, evaporating refrigerant in the evaporating coil and cooling and dehumidifying passing air, flowing vaporized refrigerant to the compressor; moving the stream of warm air against the evaporating coil to cool and dehumidify the air stream, moving cooled and dehumidified stream of air against the auxiliary coil to subcool liquid refrigerant and to warm the air stream.

DESCRIPTION OF THE PREFERRED EMBODIMENTS

Figure 1:
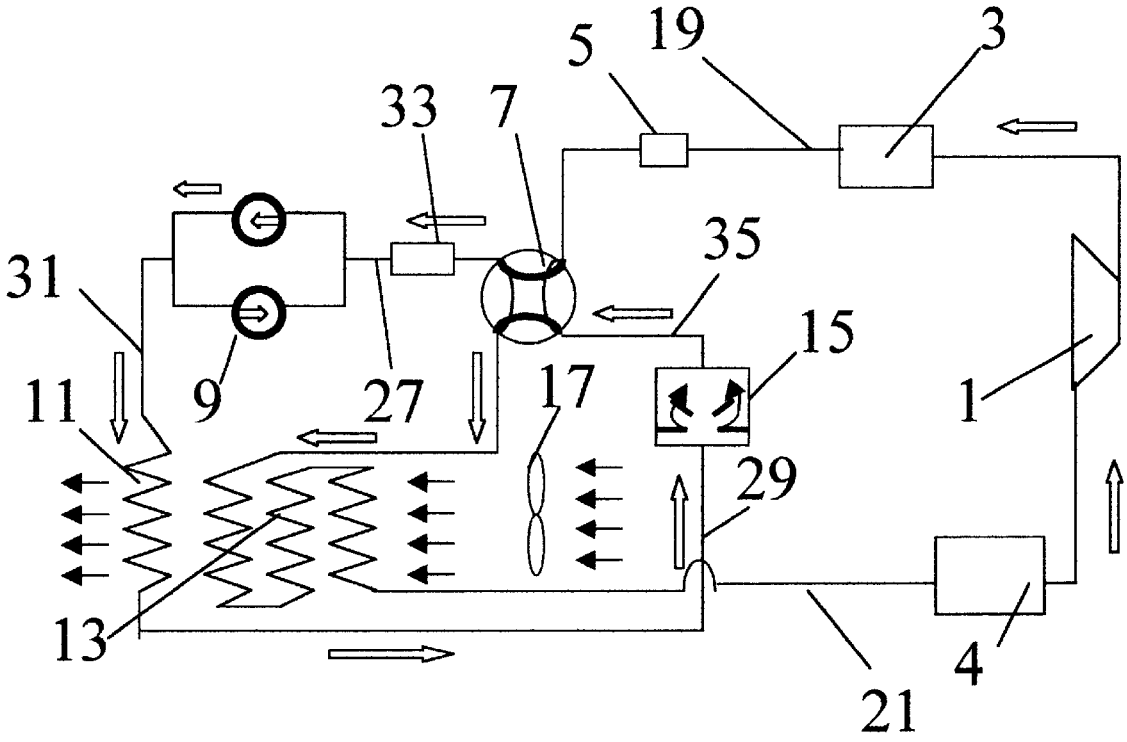
FIG. 1 is a diagrammatic view of the air conditioner with a restrictor in the cooling mode where refrigerant in the auxiliary coil absorbs heat from air.

For the purposes of promoting an understanding of the principles of the invention, reference will now be made to the embodiments illustrated in the drawings and specific language will be used to describe the same. It will nevertheless be understood that no limitation of the scope of the invention is hereby included, such alterations and further modifications of the principles of the invention as illustrated therein being contemplated as would normally occur to one skilled in the art to which this invention relates.

For simplification of the schematic and to promote better understanding of the core of the present invention a regular four-way valve of a conventional heat pump, heating means, and a humidification device are omitted on the drawings.

As shown in FIG. 1, refrigerant compressed in compressor 1 flows to condenser 3 where it liquefies and rejects heat. Then hot liquid refrigerant passes through optional dryer 5 that can also be a combination of strainer and dryer. Next, refrigerant reaches four-way valve 7. Here control means (not shown) set four-way valve 7 in a position that directs refrigerant to communication means 27. Besides delivering refrigerant to expansion device 9, refrigerant communication means 27 hold an extra amount of liquid refrigerant that is in the conventional cooling mode. To provide an extra volume accommodating liquid refrigerant communication means 27 may consist of tubing with enlarged internal diameter and length and it may also include auxiliary volume 33 or a combination of both. After it has been in communication means 27 liquid refrigerant goes to expansion device 9, where refrigerant expands. Expansion device 9 can be either a conventional capillary tube, or a device typical for heat pumps providing either equal or different restrictions in two opposite directions, such as a combination of capillary tubes with check valves, or a combination of expansion valves, or a combination of orifices, or a combination of two piston type short tube restrictors, or a capillary tube with a check valve, the capillary tube that branches into two tubes with different length or different internal diameters, or other expansion devices allowing same or different expansions of refrigerant in both directions. It can also be an electronic expansion device that controls the expansion depending on the system parameters. After it has been in expansion device 9 low pressure refrigerant flows through line 31 to auxiliary coil 11 that works as an initial part of the evaporator. In auxiliary coil 11 liquid refrigerant partly evaporates, absorbing heat from air and delivering extra cooling potential to air moved first through evaporator 13 by fan 17. After that a mixture of liquid and vapor refrigerant moves through line 29 to restrictor 15. In this direction refrigerant freely flows through restrictor 15 and four-way valve 7 to evaporator 13. Restrictor 15 may be a piston type short tube restrictor or any other device combining a restriction of the refrigerant flow in one direction with a free pass of refrigerant flowing in an opposite direction. An example of other than a piston type restrictor is a combination of an orifice or a capillary tube restricting flow in one direction and a bypass line with a check valve for free pass in the opposite direction. In evaporator 13 the rest of liquid refrigerant evaporates. Then, vaporized refrigerant flows through suction line 21 and optional accumulator 4 to compressor 1.

The stream of initially warm air driven by fan 17 initially passes through evaporator 13, cools and partially dehumidifies there, and then flows through auxiliary coil 11, where it further cools and dehumidifies. The temperature of heat transfer surfaces in both evaporator 13 and auxiliary coil 11 is relatively high: usually 45–55° F. Because the amount of moisture condensing from air depends on this temperature, dehumidification of air in the air conditioner or the heat pump working in this mode may not be sufficient.

Figure 2:
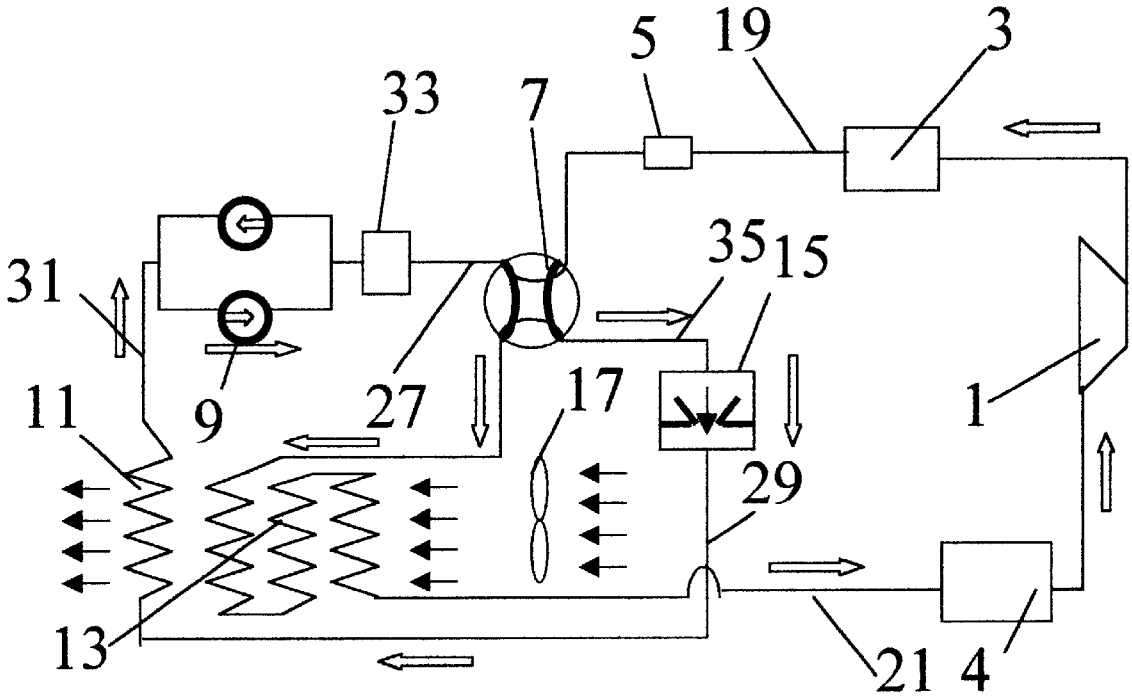
FIG. 2 is a diagrammatic view of the same air conditioner that is shown in FIG. 1 in the enhanced dehumidification mode where refrigerant in the auxiliary coil rejects heat to air.

FIG. 2 shows a diagrammatic view of the same air conditioning or a heat pump system operating in the dehumidification mode. Much like in the conventional mode, refrigerant compressed in compressor 1 flows to condenser 3 and liquefies there rejecting the heat. After that, hot liquid refrigerant passes through dryer 5. Then refrigerant reaches four-way valve 7. Now the control means set valve 7 in a position that directs refrigerant to restrictor 15. In this direction refrigerant flows through the orifice of the restrictor, expands there and through line 29 reaches auxiliary coil 11, that now works as a subcooler recondensing refrigerant that was expanded in restrictor 15 and subcooling this refrigerant. In coil 11 refrigerant rejects heat to the air stream passed through evaporator 13. After auxiliary coil 11 liquid refrigerant moves to expansion device 9 through line 31, expands there and through refrigerant communication means 27 with optional auxiliary volume 33 reaches four-way valve 7. After expansion, most of the internal volume of refrigerant communication means 27 and auxiliary volume 33 are occupied with vapor refrigerant. Liquid refrigerant that has been stored in this volume during the conventional cycle now partially fills auxiliary coil 11 and lines 31, 29, and 35. From four-way valve 7 refrigerant flows to evaporator 13. The evaporating pressure after refrigerant expansion in restrictor 15 and expansion device 9 is lower compared to the conventional cycle. The evaporating temperature of refrigerant evaporating in evaporator 13 and the temperature of heat transfer surface of the evaporator are also reduced and moisture condensation from air on the heat transfer surface of the evaporator is higher than in the conventional cycle. Next, refrigerant flows from evaporator 13 through suction line 21 and optional accumulator 4 back to compressor 1.

The stream of initially warm and humid air driven by fan 17 first passes through evaporator 13, cools and dehumidifies there, and then flows through auxiliary coil 11, where it absorbs heat from liquid refrigerant. Since the moisture condensation is higher, dehumidification of air in an air conditioner or a heat pump working in this mode is deeper than in the conventional cycle. In addition, because the air warms up absorbing heat from refrigerant in auxiliary coil 11, relative humidity of air is further reduced.

To avoid frost accumulation on the evaporator surface the system is equipped with a temperature sensor (not shown) that senses the temperature of the evaporator surface. If the temperature of the evaporator surface drops below a predetermined level, the control means either switch the system from the dehumidification mode to the conventional cooling mode or shut off the compressor.

Figure 3:
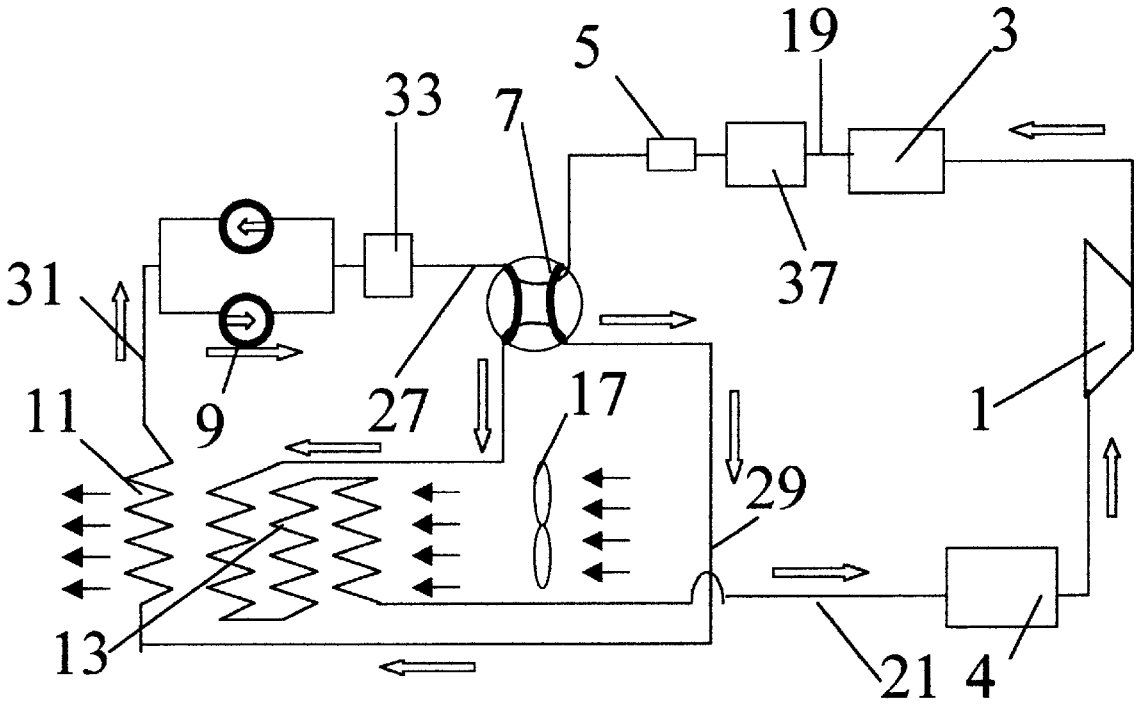
FIG. 3 is a diagrammatic view of the air conditioner without a restrictor in the mode with enhanced dehumidification.

FIG. 3 depicts an air conditioner without a restrictor in the dehumidification mode. Operation and components of this system are almost identical to the system that is illustrated in FIGS. 1 and 2. Much like in the system with a restrictor, the evaporating pressure in the cycle with enhanced dehumidification is commonly lower than in the conventional cycle, initially because of an increase in refrigeration capacity due to the subcooling. Also, a restriction in expansion device 9 can be higher when refrigerant moves from auxiliary coil 11 to expansion device 9 compared to movement in the opposite direction. The temperature of refrigerant evaporating in evaporator 13 and the temperature of the evaporator heat transfer surface are also reduced and moisture condensation from air on the heat transfer surface of the evaporator is higher than in the conventional cycle.

An essential requirement for an air conditioner working in the dehumidification mode with subcooling is having a sufficient amount of liquid refrigerant for a subcooling coil. Unlike the schematic of FIG. 2, where restrictor 15 expands refrigerant before auxiliary coil 11 and this coil is only partially filled with liquid refrigerant, in schematic of FIG. 3 auxiliary coil is completely filled with liquid. On the other hand, in both designs the condensing pressure should not be increased in the conventional cooling cycle. To achieve both demands either optional receiver 37 shall be installed or volume of refrigerant communication means 27 shall be large enough that the amount of liquid refrigerant in the refrigerant paths 29, 31 and auxiliary coil 11 during the cycle with dehumidification will be close to the amount of liquid refrigerant in communication means 27 with optional auxiliary volume 33 during the conventional cooling cycle.

Figure 4:
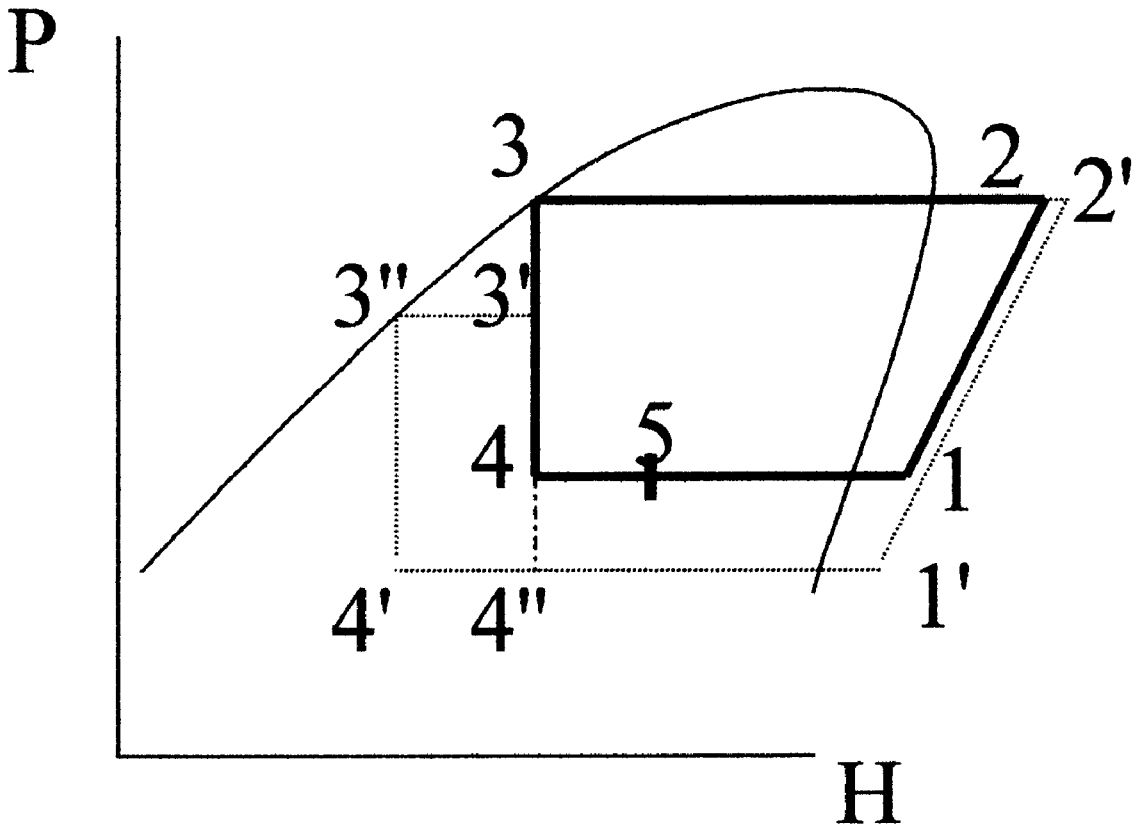
FIG. 4 is a P-H diagram of the air conditioner working according to the diagram of FIG. 1 and FIG. 2

FIG. 4 depicts a P-H diagram of the air conditioner with a restrictor for both conventional operation and operation with enhanced dehumidification.

For a system in a conventional compression refrigeration cycle depicted in FIG. 1 line 1-2 represents compressing in compressor 1, line 2-3—desuperheating and condensing in condenser 3, line 3-4—expansion in expansion device 9. Section 4-5 of line 4-1 shows evaporating in auxiliary coil 11 and section 5-1 of line 4-1 represents evaporating in evaporator 13.

For the system in a compression refrigeration cycle with enhanced dehumidification (schematic of FIG. 2) line 1'-2' represents compressing in compressor 1, line 2'-3 shows desuperheating and condensing in condenser 3, section 3-3' represents expansion in restrictor 15, line 3'-3" shows recondensing and subcooling in auxiliary coil 11, line 3"-4' represents expansion in expansion device 9, and line 4'-1' depicts evaporating in evaporator 13. In the cycle with dehumidification total expansion in restrictor 15 and expansion device 9 is higher, evaporating pressure in this cycle is lower than the evaporating pressure in the conventional cycle: line 4'-1' vs. line 4-1. Thus, the evaporator heat transfer surface temperature is lower too. That considerably increases moisture condensation on the surface. In addition, subcooling of refrigerant increases the cooling capacity of the evaporator: length of line 4'-1' is larger than the length of line 4-1. The extra enthalpy that refrigerant absorbs in auxiliary coil 11 in the cycle with enhanced dehumidification provides an additional moisture condensation when air moves through evaporator 13. After evaporator 13 air flows through auxiliary coil 11 where it picks up heat shown by line 3'-3" from liquid refrigerant. The temperature of air increases at this point. Thus, when the air conditioner operates in the way that is shown on FIG. 2, both absolute and relative humidity of air after it has been in the air conditioner or heat pump are reduced compared to the conventional operation (FIG. 1).

Figure 5:
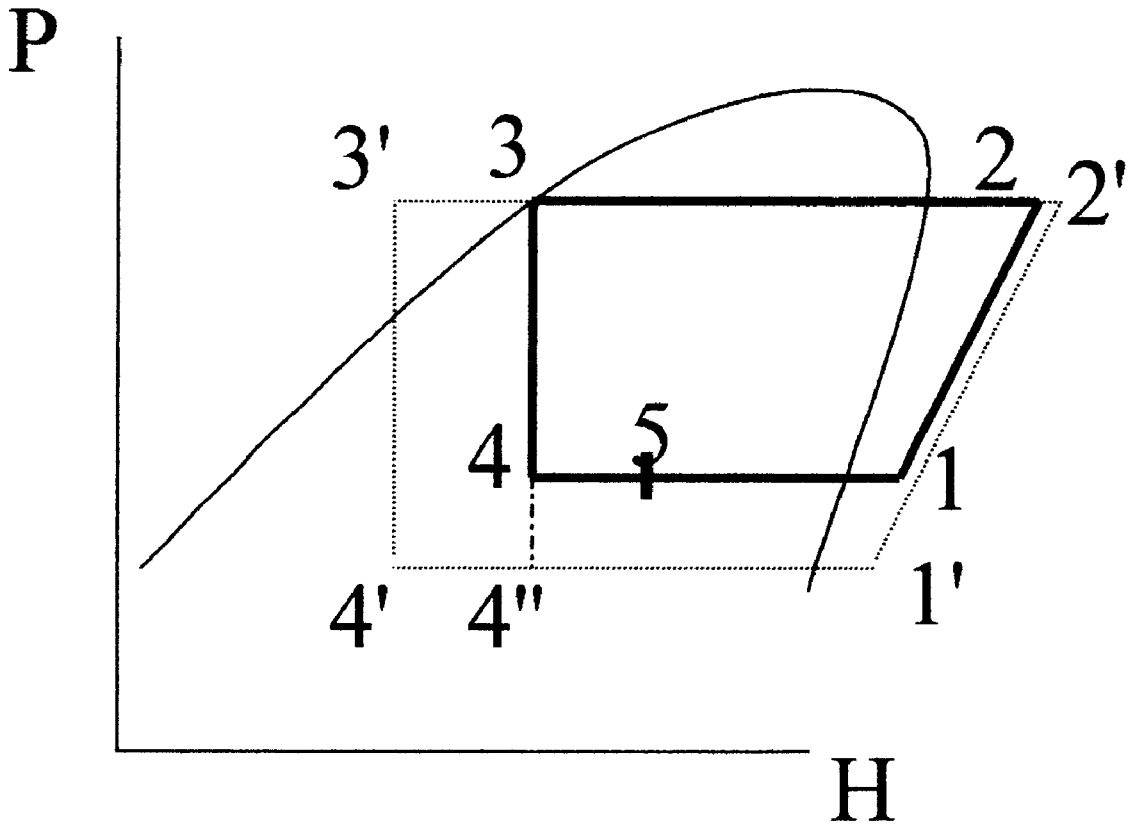
FIG. 5 is a P-H diagram of the air conditioner working according to the diagram of FIG. 3

FIG. 5 depicts a P-H diagram of the air conditioning system without a restrictor (FIG. 3). Conventional cycle 1-2-3-4 is the same as the one shown in the P-H diagram of FIG. 4 for the system of FIGS. 1 and 2. However, the cycle with enhance d dehumidification is different. Line 1'-2' represents compressing in compressor 1, line 2'-3—desuperheating and condensing in condenser 3, line 3-3'—subcooling in auxiliary coil 11, line 3'-4'—expansion in expansion device 9, line 4'-1'—evaporating in evaporator 13. To grant subcooling in auxiliary coil 11 an extra amount of liquid refrigerant in the dehumidification cycle shall be available. During the conventional cycle this refrigerant is stored in auxiliary volume 33 and/or tubing 27 (FIG. 3).

When the humidity is low, it is advantageous to run only the conventional cooling cycle because lowering evaporating temperature in the dehumidification cycle reduces the cooling capacity of the air conditioner. When there is a need to reduce humidity in the room, the conventional cycle may be alternated with the dehumidification cycle. In a conventional air conditioner or a heat pump a thermostat that senses the room temperature controls the air conditioner or the heat pump operation. To control the operation of the air conditioner or the heat pump system with dehumidification, installation of a humidistat in addition to a thermostat or a combined thermostat-humidistat may be advantageous. Thus, an operator has the ability to set not only the required room temperature but also the required humidity. When both humidity and temperature requirements are met, the control means shut down the system.

There is a possibility especially during the dehumidification cycle that the temperature of the heat transfer surface of the evaporator drops below 32° F. It may cause the ice building on the surface of the evaporator. To protect the evaporator surface from an excessive amount of ice a temperature sensor is provided. When the temperature of the evaporator surface reaches some predetermined level below 32° F. the sensor calls either to change the direction of the refrigerant flow in four-way valve 7 starting the conventional cycle or to shut off compressor 1.

To control the direction of refrigerant flow in both conventional and dehumidification modes four-way valve 7 can be substituted by a system of two-way and/or three-way valves.

If air conditioning and dehumidification of room air is done by a heat pump, the operation of the heat pump in the heating mode is identical to that of a conventional heat pump. Heating of indoor air can also be done with such means as a gas or electrical heater. Sometimes indoor air humidity is too low during the heating operation. For humidification a device delivering water to the air stream can be provided. The control means that include a thermostat and a humidistat will control the operation of the humidification device and a heater.

What is claimed is:

1. Climate control system with an air conditioner or a heat pump for conditioning air comprising:

a compressor for compressing gaseous refrigerant, a condenser for condensing refrigerant exiting the compressor, an expansion device to expand liquid refrigerant in both directions, an evaporator for evaporating liquid refrigerant after the expansion device, an auxiliary coil for either subcooling or evaporating liquid refrigerant, valve means to direct refrigerant to the auxiliary coil—either for absorbing heat from conditioning air by refrigerant in the auxiliary coil or for rejecting heat to conditioning air from refrigerant in the auxiliary coil, a refrigerant line connecting the auxiliary coil and the expansion device, a refrigerant line connecting the auxiliary coil and the valve means, refrigerant communication means to connect the valve means and the expansion device and to store extra amount of liquid refrigerant at the time when refrigerant in the auxiliary coil absorbs heat from conditioning air, a fan for moving air to be conditioned against said evaporator and against said auxiliary coil, control means to control the operation of said compressor and said fan and to control the position of said valve means.

2. The system of claim 1, wherein the valve means is a four-way valve.

3. The system of claim 1, further comprising a restrictor positioned in the refrigerant line that connects the valve means and the auxiliary coil, the restrictor expanding refrigerant in one direction and allowing a free refrigerant pass in the other direction.

4. The system of claim 1, wherein the refrigerant communication means consist of tubing and auxiliary volume.

5. The system of claim 1, wherein the control means include a thermostat and a humidistat to control the beginning and the end of the compressor and the fan operation and to control the valve means positioning the system either in a conventional cooling mode or in a cooling mode with enhanced dehumidification.

6. The system of claim 5, wherein the control means further include an evaporator surface temperature sensor signaling either to redirect the valve means or to stop the compressor when the temperature drops below a predetermined level.

7. The system of claim 5 further comprising heating means to operate in a heating mode.

8. The system of claim 7 further comprising a humidification device to humidify indoor air.

9. The system of claim 7, wherein the control means further control the beginning and the end of the heating means operation.

10. The system of claim 9, wherein the control means further control the beginning and the end of the humidification device operation.

11. Climate control system with an air conditioner or a heat pump for conditioning air comprising:

a compressor for compressing gaseous refrigerant, a condenser for condensing refrigerant exiting the compressor, an expansion device to expand liquid refrigerant in both directions, an evaporator for evaporating liquid refrigerant after the expansion device, an auxiliary coil either for subcooling or for evaporating liquid refrigerant, valve means to direct refrigerant to the auxiliary coil—either for absorbing heat from conditioning air by refrigerant in the auxiliary coil or for rejecting heat to conditioning air from refrigerant in the auxiliary coil, a receiver to accommodate a part of liquid refrigerant at the time when the auxiliary coil absorbs heat from conditioning air, a fan for moving air to be conditioned against said evaporator and against said auxiliary coil, control means to control the operation of said compressor and said fan and to control the position of said valve means.

12. The system of claim 11, wherein the valve means is a four-way valve.

13. The system of claim 11, wherein the control means include a thermostat and a humidistat to control the beginning and the end of the compressor and the fan operation and to control the valve means at the time when the system is either in a conventional cooling mode or in a cooling mode with enhanced dehumidification.

14. The system of claim 13, wherein the control means further include an evaporator surface temperature sensor signaling either to redirect the valve means or to stop the compressor when the temperature drops below a predetermined level.

15. The system of claim 13 further comprising heating means to operate in a heating mode.

16. The system of claim 15 further comprising a humidification device to humidify indoor air.

17. The system of claim 15, wherein the control means further control the beginning and the end of the heating means operation.

18. The system of claim 17, wherein the control means further control the beginning and the end of the humidification device operation.

19. A method for conditioning air with dehumidification using an air conditioning and a heat pump system, the system including a refrigerant circuit and an air circuit, the refrigerant circuit including in serial connections a compressor, a condenser, an expansion device, refrigerant communication means between the condenser and the expansion device, an auxiliary coil, an evaporating coil, and valve means to direct refrigerant flow after the condenser either to the auxiliary coil or to the expansion device and to direct refrigerant flow leaving the auxiliary coil either to the expansion device or to the evaporating coil; the air circuit including a fan moving air to be conditioned, the method comprising a cooling mode and a dehumidification mode of the system operation including the steps:

(I) in the cooling mode:

compressing gaseous refrigerant in the compressor, condensing refrigerant in the condenser, flowing liquid refrigerant through the refrigerant communication means to the expansion device, expanding refrigerant in said expansion device, flowing refrigerant to the auxiliary coil, partially evaporating refrigerant in said auxiliary coil to cool said coil and passing air, flowing partially liquid, partially vapor refrigerant to the evaporating coil, completely evaporating refrigerant in said evaporating coil to cool said coil and passing air, flowing vaporized refrigerant to said compressor, moving a stream of warm air against said evaporating coil and against said auxiliary coil to cool said air; and (II) in the dehumidification mode:

compressing gaseous refrigerant in the compressor, condensing refrigerant in the condenser, flowing hot liquid refrigerant to the cooled auxiliary coil, subcooling refrigerant in said auxiliary coil and partially warming passing air, flowing subcooled liquid refrigerant after said auxiliary coil to the expansion device, expanding refrigerant in the expansion device, flowing refrigerant to the evaporating coil, evaporating refrigerant in said evaporating coil and cooling and dehumidifying passing air, flowing vaporized refrigerant to said compressor, moving the stream of warm air against said evaporating coil to cool and dehumidify said air stream moving said cooled and dehumidified stream of air against said auxiliary coil to subcool liquid refrigerant and to warm said air stream.

* * * * *